US006557728B1

(12) United States Patent
Anderson et al.

(10) Patent No.: US 6,557,728 B1
(45) Date of Patent: May 6, 2003

(54) MUSICAL TOOTHPASTE TUBE CLOSURE

(75) Inventors: Jeffrey Blake Anderson, Newmarket (CA); Michael Barnett, Pickering (CA)

(73) Assignee: Colgate-Palmolive Company, New York, NY (US)

( * ) Notice: Subject to any disclaimer, the term of this patent is extended or adjusted under 35 U.S.C. 154(b) by 497 days.

(21) Appl. No.: 09/594,269

(22) Filed: Jun. 15, 2000

Related U.S. Application Data

(60) Provisional application No. 60/194,358, filed on Apr. 5, 2000.

(51) Int. Cl.[7] ..... B67D 5/32

(52) U.S. Cl. ..... 222/39; 222/556; 222/638; 368/10

(58) Field of Search ..... 222/39, 638, 556; 368/10; 446/408; 116/137 R

(56) References Cited

U.S. PATENT DOCUMENTS

| | | | | |
|---|---|---|---|---|
| 2,252,289 A | | 8/1941 | Kind et al. | |
| 2,777,607 A | | 1/1957 | Bellandi | |
| 3,199,730 A | | 8/1965 | Young et al. | |
| 4,121,375 A | | 10/1978 | Erickson | |
| 4,367,955 A | * | 1/1983 | Ballew | 368/10 |
| 4,801,929 A | | 1/1989 | Instance | |
| 4,836,415 A | | 6/1989 | Grussmark | |
| 4,898,060 A | | 2/1990 | To | |
| 4,991,755 A | | 2/1991 | Grusmark | |
| 5,213,234 A | | 5/1993 | Stefanopoulos | |
| 5,739,758 A | | 4/1998 | Driska et al. | |
| 5,810,201 A | | 9/1998 | Besse et al. | |
| 5,969,278 A | | 10/1999 | Tsai | |

FOREIGN PATENT DOCUMENTS

| | | |
|---|---|---|
| CA | 1260873 | 9/1989 |
| CA | 1318026 | 5/1993 |

* cited by examiner

*Primary Examiner*—Philippe Derakshani
(74) *Attorney, Agent, or Firm*—Michael J. McGreal

(57) ABSTRACT

A dentifrice closure on a dentifrice tube can emit a signal upon the opening of the closure to dispense some of the dentifrice. The closure is comprised of a base portion to attach the closure to the dentifrice tube and a lid portion that closes the dispensing opening of the dentifrice tube and which contains switch timer and signal generator. The signal generator can be a light, but preferably is a sound generator, and most preferably a music generator. Upon the lid being opened, a switch activates the timer which in turn activates the signal generator. Regardless of the position of the switch after a lid opening (the lid can be quickly closed) the signal will be emitted for a set period of time.

8 Claims, 2 Drawing Sheets

MUSICAL TOOTHPASTE TUBE CLOSURE

This application claims the benefit of Provisional application Ser. No. 60/194,358, filed Apr. 5, 2000.

FIELD OF THE INVENTION

This invention relates to a closure for a dentifrice tube which upon opening the closure, a signal, such as a musical tune emanates, for a given period of time. More particularly this invention relates to a closure that can be used to assist in defining the time that should be taken to brush ones teeth.

BACKGROUND OF THE INVENTION

The results of many studies point out that in general people do not sufficiently brush their teeth. In order to get the full benefits of the dentifrice a person should brush for about 50 to 120 seconds and preferably about 60 to 90 seconds. This will assure that all tooth surfaces have been brushed and that the anticavity, antitartar and antiplaque actives in the dentifrices can be effective. That is, they can be absorbed onto the tooth surface. This need for sufficient brushing is particularly acute with children. It is important that a child's first set of teeth remain in good health until the second set grows in.

There are many patents which disclose a timer combined with a toothbrush to indicate to the user the time needed for brushing. These include U.S. Pat. Nos. 5,438,726, 5,044,037 and 5,259,086. The latter two patents are directed to a musical tune being played to indicate the time period for brushing. In the toothpaste dispenser area there are two patents which disclose a timer to indicate the period for toothbrushing. These are U.S. Pat. Nos. 4,836,415 and 4,991,755. Each of these patents is directed to incorporating the timer into a pump dispenser. U.S. Pat. No. 4,121,375 discloses a novelty whistle which functions as the closure for the tube. The whistle can be used when not closing the tube and after the tube has been emptied and discarded. However, no structure is disclosed for a musical signal to indicate brushing time with this musical signal emanating from a dentifrice tube closure.

BRIEF SUMMARY OF THE INVENTION

The present invention is directed to a closure for a dentifrice tube where combined into the closure is a device to emit a signal such as a musical tune for a given period of time after the closure has been opened to dispense a dose of dentifrice. The closure will continue to emit the signal for the set period of time even after the closure has been closed back onto the tube exit. The emitted signal can be a light signal as well as a sound signal.

The closure is attached to a tube in the usual way. The closure is comprised of a base portion and a lid portion. The lid portion preferably contains the signal generating device and the timing device. It also will contain a battery. In addition the lid portion has a switch which is activated upon opening the closure. This switch is combined with the timer which controls the length of time of play of a signal such as a tune even when the lid is closed and putting the switch into an off-position.

In a preferred mode the upper part of the lid will have a plurality of openings to increase the volume of the musical tune emanating from the closure.

DETAILED DESCRIPTION OF THE DRAWINGS

The dentifrice tube with a signal generator in the closure to indicate the time that should be used for toothbrushing will be described in more detail with reference to the drawings.

Figure 1:
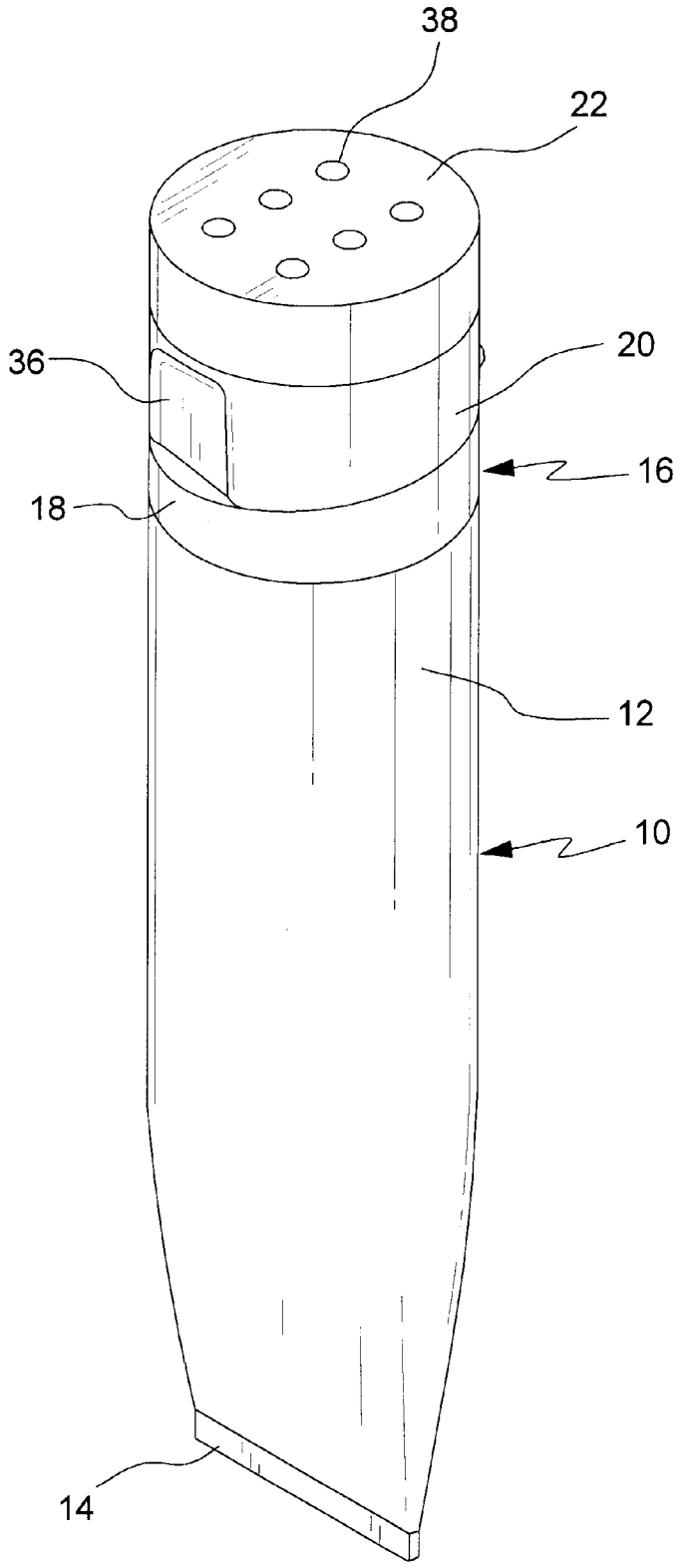
FIG. 1 shows the signaling closure on a dentifrice tube.

FIG. 1 shows dentifrice tube 10 with tube body 12 closed at one end by a crimp seal 14. The tube is closed at the other end by closure 16. The closure is comprised of a base portion 18 and a lid portion 20. The lid portion has a thumb grip 36. Attached to the lid portion is signal generating section 22. Shown are optional openings 38 for better emitting of sound from the closure.

Figure 2:
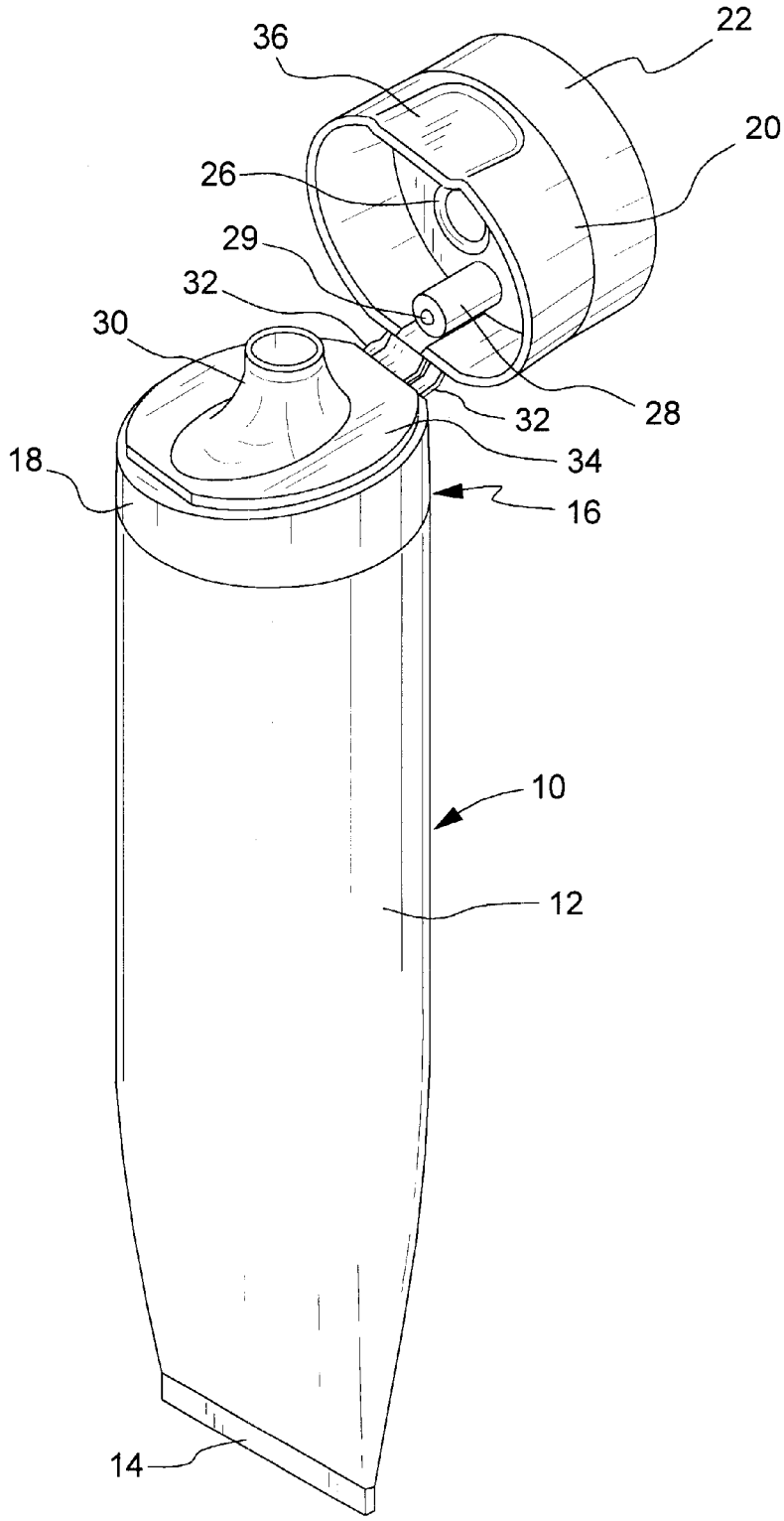
FIG. 2 shows the closure on the dentifrice tube with the lid of the closure open.

FIG. 2 shows the closure opened on the tube body 12. The closure has a spout 30. The lid portion 20 is attached to the base portion 18 by means of hinges 32. The lid portion has a spout seal 26 and switch 28. Pin 29 of the switch will contact the base portion surface 34 when the lid portion is closed. The switch with the lid portion closed is in an off position. When lid portion is opened the pin 29 of the switch extends to activate the switch to the on position and, in turn, activates a timer. The timer activates the signal generator which will produce a signal for a given period of time. The signal will continue to be generated for the set period of time even though the lid portion will be closed onto the base portion. The signal will be emitted until the end of the time period. A battery provides the power to the signal generator.

The signal that is generated can be a light or sound signal. Preferably it is a sound signal, and most preferably, a musical tune. The signal will be generated for a period of from about 50 to 120 seconds, and preferably about 60 to 90 seconds.

As shown in FIG. 1, the lid portion, and preferably the upper surface of the lid portion, will have one or more apertures 38 to emit the signal. These can be of essentially any shape or size and can be decorative in nature.

The dentifrice tube and closure will be comprised of the usual materials. The closure will be injection molded from polyethylene or polypropylene. However, there is no restriction on the materials to be used. The tube will have a conventional tube structure.

Any conventional switch, timer and sound generator can be used. These parts are conventionally used in various toys.

What is claimed is:

1. A dentifrice tube and closure said dentifrice tube closed on one end and having a dispensing opening at another end, said dispensing opening being closed by a closure, said closure having a base portion and a lid portion, said base portion attaching said closure to the another end of said dentifrice tube, said lid portion including a signal generator, a timer and a switch, said switch being in contact with said base portion when said lid portion is closed onto said base portion whereby when said lid portion is opened relative to said base portion said switch activates said timer which activates said signal generator to emit a signal for a given period of time.

2. A dentifrice tube and closure as in claim 1 wherein said signal generator is a sound generator.

3. A dentifrice tube and closure as in claim 2 wherein said sound generator is a music sound generator.

4. A dentifrice tube and closure as in claim 1 wherein said signal generator is a light source.

5. A dentifrice tube and closure as in claim 1 wherein base portion has a means for removably connecting said closure to said tube.

6. A dentifrice tube and closure as in claim 5 wherein said removable means comprises a set of mating threads on said tube and on said closure.

7. A dentifrice tube and closure as in claim 1 wherein said signal generator plays a tune for from about 50 to about 120 seconds.

8. A dentifrice tube and closure as in claim 7 wherein said signal generator plays a tune for about 60 to 90 seconds.

* * * * *